US005395423A

United States Patent [19]

Suwa et al.

[11] Patent Number: 5,395,423

[45] Date of Patent: Mar. 7, 1995

[54] METHOD OF MELTING METALS

[75] Inventors: Toshio Suwa; Nobuaki Kobayashi; Naoji Konno, all of Yamanashi, Japan

[73] Assignee: Nippon Sanso Corporation, Tokyo, Japan

[21] Appl. No.: 37,167

[22] Filed: Mar. 26, 1993

[30] Foreign Application Priority Data

Mar. 27, 1992 [JP] Japan ..... 4-071524
Mar. 30, 1992 [JP] Japan ..... 4-074412
Mar. 30, 1992 [JP] Japan ..... 4-074413

[51] Int. Cl.[6] ..... C22B 9/16

[52] U.S. Cl. ..... 75/380; 75/414; 75/571

[58] Field of Search ..... 75/571, 573, 575, 581, 75/382, 380, 414

[56] References Cited

U.S. PATENT DOCUMENTS 1,376,479 5/1921 Stoughton ..... 75/380
2,997,288 8/1961 Schwechheimer et al. ..... 75/573
4,561,637 12/1985 Schleimer ..... 266/900
4,681,535 7/1987 Kobari et al. .
4,786,321 11/1988 Hoster et al. ..... 75/575
4,828,607 5/1989 Dighe et al. ..... 75/581
4,877,449 10/1989 Khinkis ..... 75/414
4,928,605 5/1990 Suwa et al. .

FOREIGN PATENT DOCUMENTS 2 704 101 8/1977 Germany .
3 422 267 12/1985 Germany .
36 10498 10/1987 Germany .
57-041 521 6/1982 Japan .
62-060 810 8/1987 Japan .
62-116 813 11/1987 Japan .
63-047 310 7/1988 Japan .

OTHER PUBLICATIONS

Derwent Publications Ltd., London, GB; AN 73-263-78U & SU-A-349 716; Abstract.

*Primary Examiner*—Melvyn J. Andrews
*Attorney, Agent, or Firm*—Armstrong, Westerman, Hattori, McLeland & Naughton

[57] ABSTRACT

Disclosed is a method of melting a metal. In a melting furnace, a metallic material is melted by heating it directly with the flame from a fuel burner using an oxygen gas having a purity of 60 to 100% as a combustion assisting gas. Meanwhile, the combustion assisting gas is heated before it is fed to the burner.

6 Claims, 2 Drawing Sheets

METHOD OF MELTING METALS

BACKGROUND OF THE INVENTION AND RELATED ART STATEMENT

This invention relates to a method of melting a metal, more particularly to a method of melting a metal by heating it directly with the flame from a fuel burner using a gas containing at least 60% of oxygen as a combustion assisting gas.

While an electric furnace is mainly used for melting metals, particularly iron scraps, recently an oxygen-assisted fuel burner in which a liquid fuel such as heavy oil is burned with the aid of oxygen is additionally used. Such a burner is used in order to accelerate the melting speed in the electric furnace as well as to obviate so-called cold spots in the metals. Meanwhile, the oxygen injection method is also employed as a technique of enhancing productivity. In this method, oxygen is injected into the melt in the furnace to effect an oxidation reaction whereby to melt the scrap by the heat of reaction.

However, the first method of melting a metal using an electric furnace described above involves a disadvantage that cold spots are inevitably left in the metal and that it must resort to the electric power as the source of energy, although it has an advantage that it can readily yield a high temperature and allows easy temperature adjustment. Meanwhile, in the second method in which an oxygen-assisted fuel burner is used in addition to the electric furnace, 60 to 80% of the total energy used is from electric power, and besides it is well known that the energy efficiency of the electric power is only about 20 to 25%, when generating efficiency, melting efficiency, etc. are all taken into consideration. In addition, referring to the generation of $CO_2$ gas which is notorious as a causative of global environmental disruption, it is reported that about 150 $m^3$ of $CO_2$ is generated for melting 1 ton of metal scraps utilizing the electric power generated by use of heavy oils, so that a countermeasure therefor must be taken.

In the oxygen injection method, the above problems can be cleared since no electric power is employed. However, in this method, oxygen, a micropowdery coal and coke are injected to the melt to carry out an oxidation reaction and effect melting of the metal, so that a portion of the melt must constantly be allowed to remain in the melting furnace. This may cause no problem when the melting operation is carried out continuously, but inevitably yields poor productivity in the case of a batchwise melting operation or of intermittent melting operation, since the melt cannot entirely be removed from the melting furnace.

OBJECT AND SUMMARY OF THE INVENTION

This invention is directed to improve the melting efficiency when a metallic material is melted by heating directly with the flame from a fuel burner and to provide a method of melting a metallic material such as iron scraps using a micropowdery coal as a fuel, the use of which have been believed to be impossible.

According to a first aspect of the invention, a metallic material introduced to a melting furnace is melted by heating it directly with the flame from a fuel burner using an oxygen gas having a purity of 60 to 100% as a combustion assisting gas, wherein the combustion assisting gas is heated before it is fed to the fuel burner.

In a second aspect of the invention, the combustion assisting gas according to the first aspect of the invention is heated by the combustion gas discharged from the melting furnace.

In a third aspect of the invention, the combustion assisting gas according to the first aspect of the invention is heated by the combustion gas discharged from the melting furnace and used for preheating the metallic material.

In a fourth aspect of the invention, the fuel to be supplied to the fuel burner according to the first aspect of the invention is a micropowdery coal.

In a fifth aspect of the invention, the combustion gas according to the fourth aspect of the invention, after heating of the combustion assisting gas, is partly pressurized to be used as a carrier gas for the micropowdery coal.

In a sixth aspect of the invention, the combustion assisting gas according to the first aspect of the invention is a heated oxygen gas obtained by burning a heating fuel in an oxygen-rich atmosphere.

In a seventh aspect of the invention, the amount of the heating fuel according to the sixth aspect of the invention is controlled by detecting the internal temperature of the melting furnace.

In an eighth aspect of the invention, the number of the melting furnace according to the first aspect of the invention is plural, and the heating of the combustion assisting gas is carried out by the heat exchange with the combustion gas exhausted from at least one of these melting furnaces and introduced to a common heat exchanger.

The method of melting a metallic material according to this invention enjoys excellent heat efficiency, since the metallic material is melted by heating it directly with the flame from a fuel burner using an oxygen gas having a purity of 60 to 100% as the combustion assisting gas. Further, combustion efficiency can be improved, since the combustion assisting gas is heated before it is fed to the burner.

By using the combustion gas as a source for preheating the combustion assisting gas and/or the metallic material, the melting operation can be carried out in higher heat efficiency, and thus metals are expected to be melted economically coupled with the improved melting efficiency for the metallic material.

It has been difficult in the prior art to melt a metallic material having a high melting point by using a micropowdery coal as the fuel for the burner. However, according to the method of the invention, it becomes possible to achieve melting of high-melting point metallic materials, e.g. iron scraps, because of the improved heat efficiency and combustion efficiency.

The use of combustion gas, having heated the combustion assisting gas, partly as the carrier gas for the micropowdery coal can prevent accidental burning or explosion, since the combustion gas contains substantially no oxygen.

Heating of the combustion assisting gas can be achieved even in a batchwise melting operation by burning a heating fuel in an oxygen-rich atmosphere to heat the oxygen in the atmosphere and using the thus heated oxygen gas as the combustion assisting gas. Meanwhile, it has been found that there is a correlation between the internal temperature of the melting furnace and the desired temperature of the combustion assisting gas to be heated to, so that the consumption of the heating fuel can be held to a minimum by detecting the internal temperature of the melting furnace and controlling the amount of the fuel correspondingly.

When the melting operation is carried out in a plurality of melting furnaces, the energy of the combustion gas can effectively be utilized by constantly introducing the combustion gas to a heat exchanger common to the respective melting furnaces, and thus there is no need of separately providing a heat source for heating the combustion assisting gas.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 1:
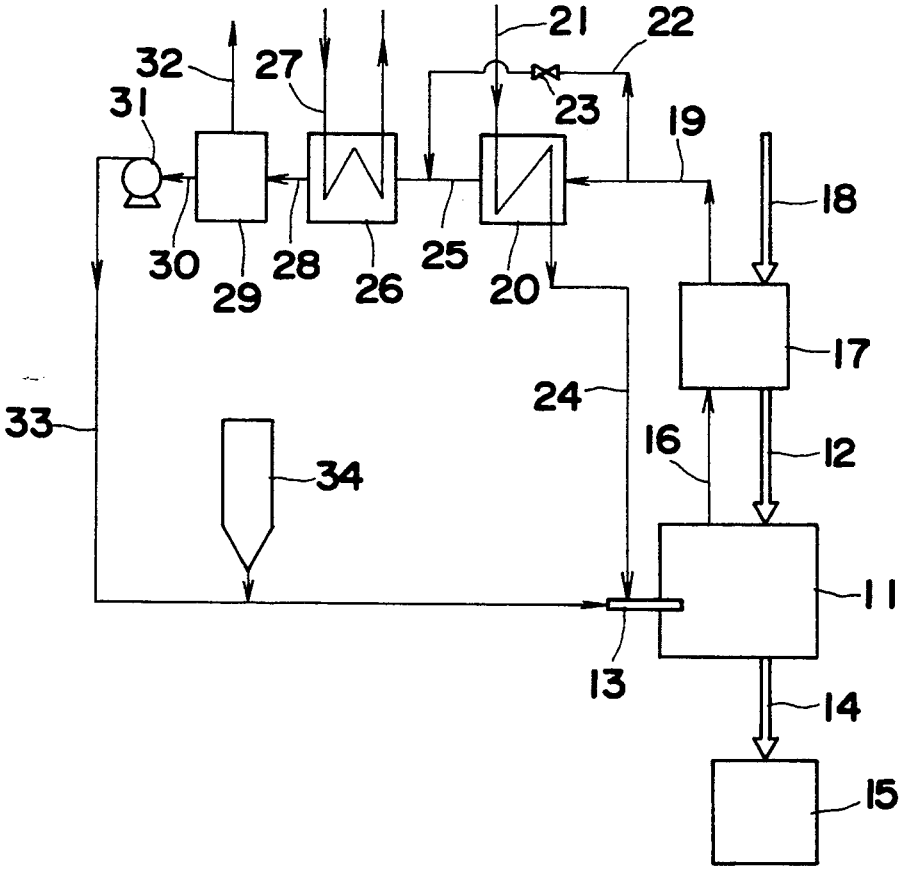
FIG. 1 shows a flow diagram for explaining one embodiment of the invention.

One embodiment of the invention will be described below referring to FIG. 1.

A granular, linear, planar, flaky or massive metallic material is introduced to a melting furnace 11 through an inlet 12. The metallic material thus introduced to the melting furnace 11 is melted by bringing it into direct contact with the flame from one or plurality of fuel burners 13 (hereinafter simply referred to as the burner 13). To the burner 13 are fed, for example, a micropowdery coal as the fuel and an oxygen gas having a purity of 60 to 100% as the combustion assisting gas.

The metal melted in the melting furnace 11 is removed through the outlet 14 and transferred to a vessel 15 in an appropriate manner well known in the art.

While the metallic material is melted in the melting furnace at a high temperature of 1,600° C. or more, a combustion gas having almost the same temperature is generated. The combustion gas is led out through the exhaust pipe 16 from the melting furnace 11 and then introduced to a preheater 17 for preheating the metallic material charged from an inlet 18 before introduced to the melting furnace.

The combustion gas introduced to the preheater 17 and passed through the metallic material stacked in the preheater 17 to effect preheating thereof is led out through a pipe 19 and introduced to a heat exchanger 20. Heat exchange is performed between the combustion gas introduced to the heat exchanger 20 and the 60 to 100% purity oxygen gas having a normal temperature to heat the oxygen gas to a desired temperature of about 800° C. or less. The reference number 22 denotes a bypass pipe having a control valve 23 for controlling the flow rate of the combustion gas to be introduced to the heat exchanger 20, and the bypass pipe 22 is provided so as to adjust the temperature of the oxygen gas thus heated by the heat exchange with the combustion gas to a desired level.

The oxygen gas heated, for example, to 400° C. in the heat exchanger 20 is led out through a pipe 24 from the heat exchanger 20 and fed to the burner 13 as a combustion assisting gas.

The combustion gas led out through a pipe 25 from the heat exchanger 20 is combined with the portion of the combustion gas passed through the bypass pipe 22 and introduced to a cooler 26. The combustion gas introduced to the cooler 26 is cooled to a desired temperature by heat exchange with a cooling medium such as air and water flowing through a pipe 27.

The combustion gas cooled in the cooler 26 is fed to a dust remover 29 through a pipe 28 and subjected there to dust removal treatment. The thus treated combustion gas is led out in a necessary amount through a pipe 30 and sucked into a blower 31, while the rest of the combustion gas is exhausted through a pipe 32.

The combustion gas sucked into the blower 31 is pressurized and led through a pipe 33 to be used as a carrier gas for a solid fuel contained in a micropowdery coal fuel tank 34, whereby the solid fuel can be fed to the burner 13.

As a result of a melting test carried out according to the above embodiment using a micropowdery coal as the fuel and an oxygen gas heated to 400° C. as the combustion assisting gas, which were fed to the burner in the amounts of 150 kg/h and 225 $Nm^3/h$, respectively, a heat efficiency of about 47% was obtained using the micropowdery coal per unit weight of the metallic material of 80 kg/t at the melting rate of 1.9 t/h.

Melting tests were further carried out for iron scraps using a heavy oil, LPG and a micropowdery coal, respectively, while changing the purity of the oxygen gas to give the melting efficiency data as shown in the following Table 1. The speed of the combustion assisting gas to be jetted out of the burner was 150 m/s, and the temperature thereof was about 600° C.

TABLE 1

| Oxygen purity (%) | Melting efficiency (%) | | |
|---|---|---|---|
| | Heavy oil | LPG | Micropowdery coal |
| 40 | 15 | 13 | 0 |
| 60 | 45 | 40 | 35 |
| 80 | 55 | 47 | 45 |
| 100 | 60 | 50 | 47 |

As apparently shown in FIG. 1, the effect of the invention can notably be exhibited by using an oxygen gas having a purity of 60% or more as the combustion assisting gas, irrespective of the kind of fuel. Accordingly, it is desired to use a 60 to 100% purity oxygen gas as the combustion assisting gas.

Incidentally, while the inlet 12 for feeding the metallic material to the melting furnace 11 and the exhaust pipe 16 for feeding the combustion gas to the preheater 17 are provided separately in the above embodiment, the arrangement thereof may arbitrarily be modified; e.g. they may be integrated into one body and provided on the top of the melting furnace. Meanwhile, when the combustion gas is used as the source for heating the combustion assisting gas, as described above, the control means for heating the combustion assisting gas may not be limited to the one described in the above embodiment. Further, the carrier gas flowing through the pipe 33 may preferably be of normal temperature or higher, and cooling of the carrier gas is not always necessary.

Now referring to melting of iron scraps, it is usually carried out batchwise. Accordingly, to carry out heating of the combustion assisting gas using the combustion gas exhausted from the melting furnace sometimes makes the temperature control of the combustion assisting gas difficult.

Figure 2:
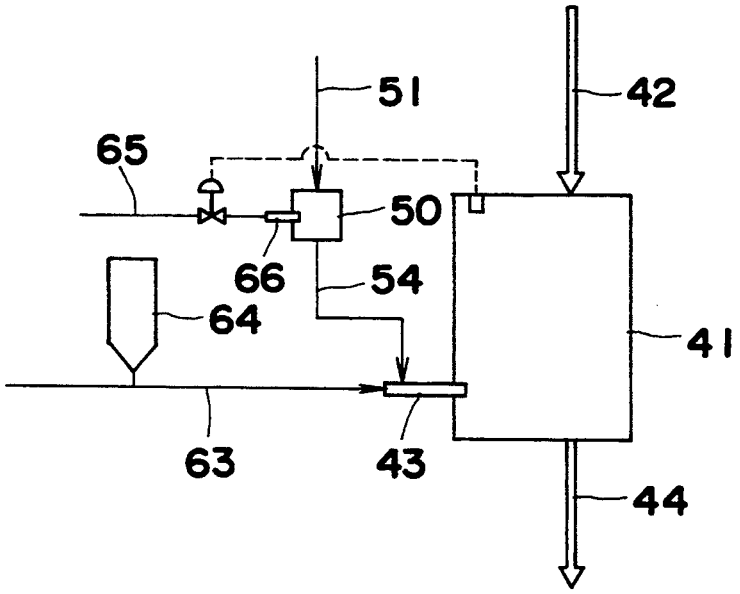
FIG. 2 shows a flow diagram for explaining another embodiment of the invention.

Another embodiment which can cope with such problem will be described below referring to FIG. 2.

A metallic material introduced from an inlet 42 to a melting furnace 41 is melted by bringing it into direct contact with the furnace from one or plurality of fuel burners 43 (hereinafter simply referred to as the burner 43) and discharged from an outlet 44 in an appropriate manner well known in the art. A micropowdery coal is fed as the fuel to the burner 43 through a pipe 63 from a tank 64 in a manner well known in the art. Meanwhile, an oxygen gas having a purity of 60 to 100% is fed to a preheater 50 through a pipe 51, and after it is heated there to a high temperature, fed to the burner 43 through a pipe 54.

The preheater 50 is provided with a preheating burner 66 to which a gaseous or liquid fuel such as LPG and LNG or heavy oil or kerosine is supplied through a pipe 65. The fuel supplied to the preheating burner 66 is burned in an oxygen-rich atmosphere in the preheater 50 to heat the oxygen gas introduced thereto through the pipe 51.

As a result of a melting test carried out according to the above embodiment using a burner 43 to which a micropowdery coal and an oxygen gas are fed at the rates of 150 kg/h and 225 $Nm^3/h$ respectively, as well as, a preheating burner 66 to which LPG and an oxygen gas are fed at the rates of 3 $Nm^3/h$ and 15 $Nm^3/h$ respectively, the oxygen gas was heated to about 700° C. by burning the LPG in the preheater 50 before fed to the burner 43, and thus a combustion temperature of 2,000° C. or higher was obtained.

The temperature in the melting furnace 41 is detected by a temperature detector 67 provided therein. According to the detection signals from the detector 67, a flow control valve 68 provided in a pipe 65 is designed to be controlled to control the flow rate of the fuel to be supplied to the preheating burner 66, in turn, the required temperature for the oxygen gas to be heated in the preheater 50.

This is carried out based on the finding that the temperature of the combustion assisting gas necessary for melting the metallic material changes depending on the internal temperature of the melting furnace 41, and the relationship between the internal temperature of the melting furnace and the temperature for the combustion assisting gas necessary for melting the iron scraps using a micropowdery coal at the rate of 150 kg/h is as shown below.

TABLE 2

| Internal temperature of melting furnace (°C.) | Required temperature of combustion assisting gas (°C.) |
|---|---|
| 600 | 600 |
| 1,400 | 500 |
| 1,600 | 400 |
| 1,700 | 400 |

It can be appreciated from Table 2 that the higher the internal temperature of the melting furnace 41 is, the lower may be the required temperature for the combustion assisting gas to be heated, and thus the preheating fuel can be saved by controlling the amount thereof. The amount of LPG required for heating an oxygen gas to be fed at a rate of 225 $Nm^3/h$ to 400° C. using the burner to which a micropowdery coal and an oxygen gas are fed in the amounts 150 kg/h and 225 $Nm^3/h$, respectively, was 1.5 $Nm^3/h$, while the amount of the oxygen gas necessary for burning the LPG was 7.5 $Nm^3/h$.

Figure 3:
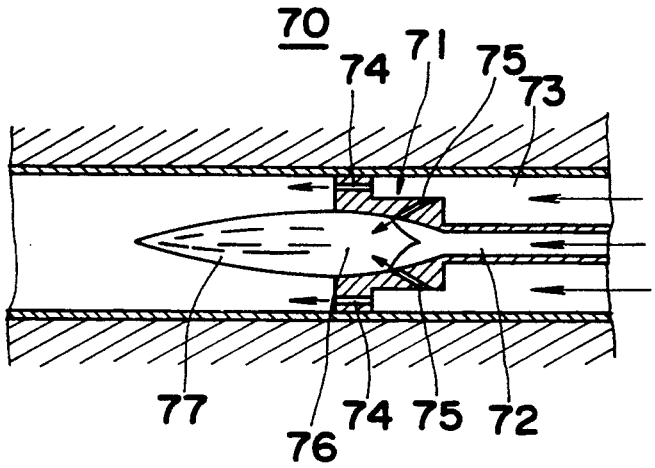
FIG. 3 shows in cross section a preheater for explaining a variation of the embodiment shown in FIG. 2.

Incidentally, while the pipe 51 for feeding the combustion assisting gas to the preheater 50 and the preheating burner 66 are provided separately on the preheater 50, they may also be arranged as shown in FIG. 3.

Namely, a preheating burner 71 is disposed in a preheater 70. A gaseous or liquid preheating fuel is supplied through a path 72 defined along the axis of the preheating burner 71. While the oxygen gas used as the combustion assisting gas is supplied through a path 73 defined to surround the path 72 and passed through a path 74, the oxygen gas partly flows through a path 75 into a combustion chamber 76 to let the preheating fuel supplied through the path 72 burn and form a flame 77.

The combustion assisting gas passed through the path 74 is heated by the flame 77, and the temperature of the combustion assisting gas can be controlled by controlling the amount of the fuel to be fed to the burner 71.

Incidentally, it is also possible to use the combustion gas as the source for heating the combustion assisting gas instead of the flame from the preheating burner 71 in the above embodiment, when the temperature of the combustion gas exhausted from the melting furnace 41 is elevated to a level suitable for heating the combustion assisting gas.

Figure 4:
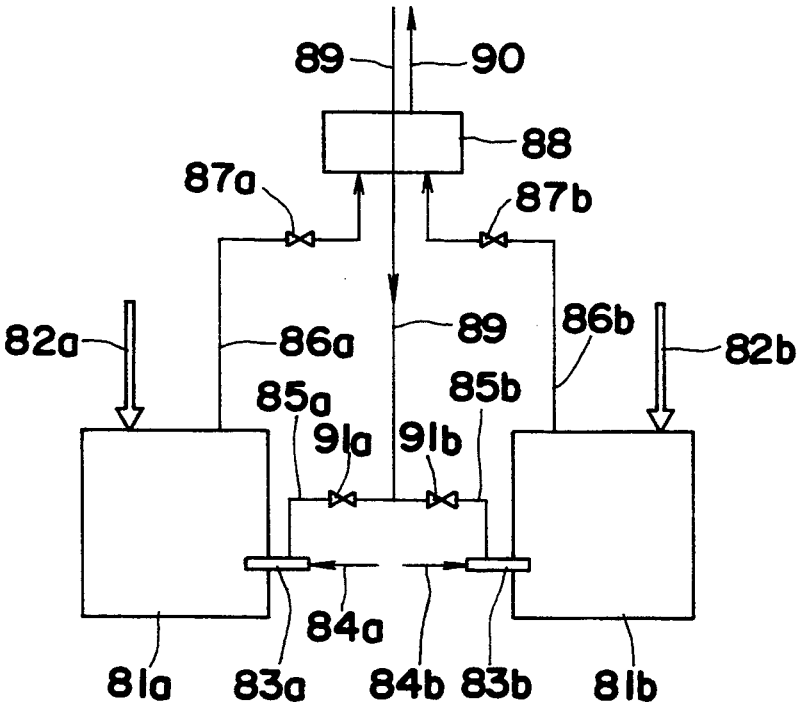
FIG. 4 shows a flow diagram for explaining still another embodiment of the invention.

Next, another embodiment suitable for operating more than one melting furnace will be described below referring to FIG. 4.

Burners 83*a*, 83*b* are disposed to melting furnaces 81*a*, 81*b* to which metallic materials are introduced through inlets 82*a*, 82*b*, respectively. A micropowdery coal fuel and a combustion assisting gas having an oxygen purity of 60 to 100% are fed through pipes 84*a*, 84*b* and pipes 85*a*, 85*b* to the burners 83*a*, 83*b*, respectively, and burned to allow the metallic materials to melt by bringing them into direct contact with the flames from the burners 83*a*, 83*b*.

The combustion gas having a temperature of 1,600° C. or higher in the melting furnaces 81*a*, 81*b* is led out through pipes 86*a*, 86*b* having valves 87*a*, 87*b* therein, respectively, and introduced to a common heat exchanger 88. Heat exchange is performed between the combustion gas introduced to the heat exchanger 88 and the combustion assisting gas flowing through a pipe 89 penetrating through the heat exchanger 88. The combustion gas is then led out through a pipe 90, subjected to known treatments such as dust removal and cooling and exhausted. Incidentally, the exhaust gas may partly be used as a carrier gas for the micropowdery coal fuel to be fed to the burners 83*a*, 83*b* through the pipes 84*a*, 84*b*, respectively.

The combustion assisting gas heated in the heat exchanger 88 is fed through the pipe 89 and the pipes 85*a*, 85*b*, having valves 91*a*, 91*b* therein, diverged therefrom to the burners 83*a*, 83*b* through the pipes 85*a*, 85*b*, respectively.

Accordingly, when the melting furnace 81*a* is in operation and the melting furnace 81*b* is out of operation, the valves 87*a*, 91*a* are open, while the valves 87*b*, 91*b* are closed. Thus, the combustion gas in the melting furnace 81*a* is introduced to the heat exchanger 88 through the pipe 86*a* and then exhausted through the pipe 90. Meanwhile, the combustion assisting gas introduced to the heat exchanger 88 through the pipe 89 is subjected to heat exchange with the combustion gas in the heat exchanger 88 and heated to a desired temperature, e.g. 400° to 800° C., supplied to the burner 83*a* through the pipes 89 and 85*a* to assist burning of the micropowdery coal fed through the pipe 84*a*.

At the end of the melting operation in the melting furnace 81*a*, or in the state where the combustion gas in the melting furnace 81*a* is being fed to the heat exchanger 88, operation of the furnace 81*b* is started. Namely, the valve 91*b* is let open to supply the heated combustion assisting gas to the burner 83*b* as well as, to supply the micropowdery coal through the pipe 84*b* and burned at the burner 83*b*. Subsequently, the valve 87*b* is let open to allow the combustion gas in the melting furnace 81*b* to flow into the heat exchanger 88. In this state, the valves 87*a*, 91*a* are closed to complete operation in the melting furnace 81*a*. In this embodiment, the melting furnaces 81*a* and 81*b* are operated alternatively so that the combustion gas may constantly be supplied to the heat exchanger 88.

It should be appreciated that the melting furnace 81*b* is in a preheating step when the melting furnace 81*a* is in a melting step, provided that the metal melting operation is divided, for example, into a preheating step and a melting step. Then, upon completion of the melting step in the melting furnace 81*a*, the operations in the melting furnaces 81*a*, 81*b* are interchanged such that the melting furnace 81*b* may proceed with the melting step, while the melting furnace 81*a* may proceed with the preheating step.

Although some of the preferred embodiments have been described herein, it will be apparent to those skilled in the art that the present invention is not limited thereto and many other variations and modifications are possible without departing from the spirit or scope of the invention.

What is claimed is:

1. A method of melting a metallic material, which comprises melting a metallic material introduced to a melting furnace by heating the metallic material directly with a flame from a fuel burner using micropowdery coal as a fuel and using an oxygen containing gas having oxygen content of 60 to 100% as a combustion assisting gas to produce a combustion gas, said combustion assisting gas being heated to a temperature of at least 400° C. before the combustion assisting gas is fed to said burner, and said combustion gas, after being used for heating said combustion assisting gas, being partly pressurized to be used as a carrier gas for said micropowdery coal.

2. The method of melting a metallic material according to claim 1, wherein said combustion assisting gas is heated by combustion gas discharged from said melting furnace.

3. The method of melting a metallic material according to claim 1, wherein said combustion assisting gas is heated by combustion gas discharged from said melting furnace and used for preheating said metallic material.

4. The method of melting a metallic material according to claim 1, wherein said combustion assisting gas is heated before the combustion assisting gas is fed to said burner by burning a fuel in an oxygen-rich atmosphere.

5. The method of melting a metallic material according to claim 4, wherein the amount of fuel fed to said burner is controlled by detecting an internal temperature of said melting furnace.

6. The method of melting a metallic material according to claim 1, wherein the number of the melting furnaces is plural, and the heating of said combustion assisting gas is carried out in a heat exchanger by the heat exchange with a combustion gas exhausted from at least one of these melting furnaces.

* * * * *